US010359185B2

(12) United States Patent
Tang et al.

(10) Patent No.: US 10,359,185 B2
(45) Date of Patent: Jul. 23, 2019

(54) LIGHT ASSEMBLY WITH SEPARABLE THREADED CONNECTOR

(71) Applicants: Yi-Wen Tang, Taichung (TW); Jui-Chi Tang, Taichung (TW)

(72) Inventors: Yi-Wen Tang, Taichung (TW); Jui-Chi Tang, Taichung (TW)

( * ) Notice: Subject to any disclaimer, the term of this patent is extended or adjusted under 35 U.S.C. 154(b) by 101 days.

(21) Appl. No.: 15/356,678

(22) Filed: Nov. 21, 2016

(65) Prior Publication Data

US 2018/0142866 A1 May 24, 2018

(51) Int. Cl.

| | |
|---|---|
| ***F21V 29/83*** | (2015.01) |
| ***F21V 31/00*** | (2006.01) |
| ***F21V 17/12*** | (2006.01) |
| ***F21V 1/00*** | (2006.01) |
| *F21V 3/02* | (2006.01) |
| *F21V 17/04* | (2006.01) |

(52) U.S. Cl.

CPC ..... *F21V 29/83* (2015.01); *F21V 1/00* (2013.01); *F21V 17/12* (2013.01); *F21V 31/005* (2013.01); *F21V 3/02* (2013.01); *F21V 17/04* (2013.01)

(58) Field of Classification Search

CPC ..... F21V 17/12; F21V 17/04; F21V 29/83

See application file for complete search history.

(56) References Cited

U.S. PATENT DOCUMENTS

| | | | | |
|---|---|---|---|---|
| 7,144,135 | B2 * | 12/2006 | Martin | F21S 6/003 362/294 |
| 8,491,246 | B2 * | 7/2013 | Chao | F16B 21/02 411/341 |
| 2004/0095777 | A1 * | 5/2004 | Trenchard | B63B 45/04 362/477 |
| 2006/0203499 | A1 * | 9/2006 | Choi | F21V 11/16 362/382 |
| 2010/0002451 | A1 * | 1/2010 | Reynolds | F21S 8/02 362/363 |
| 2013/0069100 | A1 * | 3/2013 | Ahmed | F21V 15/01 257/99 |
| 2015/0124435 | A1 * | 5/2015 | Masterman | F21V 5/04 362/101 |
| 2015/0292692 | A1 * | 10/2015 | Elmvang | F21S 8/026 362/294 |
| 2018/0119909 | A1 * | 5/2018 | Rizzo | F21V 3/061 |

* cited by examiner

*Primary Examiner* — Anh T Mai
*Assistant Examiner* — Michael Chiang

(57) ABSTRACT

A light assembly with separable threaded connector includes a body has a recessed area and a first flange is formed on the edge of the recessed area. A connector is received in the recessed area and contacts the first flange. The connector has a first threaded portion defined in the inner periphery thereof. An illumination member has a second threaded portion which is threadedly connected to the first threaded portion to connect the illumination member with the connector. A base is connected to one end of the illumination member and protrudes beyond the body. The base is a standard base. The illumination member can be separated from the connector. The illumination member and the rest of the parts of the light assembly are individually packed.

6 Claims, 14 Drawing Sheets

LIGHT ASSEMBLY WITH SEPARABLE THREADED CONNECTOR

BACKGROUND OF THE INVENTION

1. Fields of the Invention

The present invention relates to a light assembly with separable threaded connector, and more particularly, to a light assembly that includes a body, a connector and an illumination member which is threadedly connected to the connector.

2. Descriptions of Related Art

The conventional light assembly known to applicant is disclosed in U.S. Pat. No. 7,144,135 and comprises a shell; an optical reflector disposed at least partially within the shell, wherein a space is formed between the optical reflector and the shell; at least one light emitting diode disposed within the optical reflector; a heat sink disposed at least partially within the shell, the light emitting diode being mounted to the heat sink; a motor and a fan in flow communication with the space, the fan being configured to move air over the heat sink and through the space; and a screw type electrical contact base coupled to the shell.

However, the base and the shell are integrally formed as an one piece when the light assembly is manufactured, so that the whole light assembly occupies a significant space and a larger packing material is needed to pack the light assembly. Besides, the empty room in the box for receiving the light assembly requires a lot of cushion material to fill the empty room. The larger boxes also increase higher transportation cost.

The base is integrally connected with the shell, so that once the base is damaged, the shell is discarded with the base. The shell is made of metal which is expensive, and this wastes a lot expensive material.

The present invention intends to provide a light assembly which saves the packing material. The illumination member and the light assembly are packed individually so as to reduce the storage and transportation space required.

SUMMARY OF THE INVENTION

The present invention relates to a light assembly which comprises a body having a first opening in the first end thereof, and a second opening is located in the second end of the body. The first opening is larger than the second opening. The body has a recessed area defined in the second end of the body. The recessed area is a circular recess and has a first flange. Multiple first holes are defined through the first flange. The body has a first outer periphery on the second end of the body. The body has a second outer periphery on the first end of the body.

A connector is received in the recessed area and contacts the first flange. The connector is a ring-shaped member and has multiple third holes which are located correspond to the first holes. The number of the third holes is the same as that of the first holes. The connector has a first threaded portion defined in the inner periphery thereof.

Multiple first threaded members extend through the first holes and the third holes, and are connected to multiple second threaded members so as to connect the connector to the body. The first threaded members have outer threads and the second threaded members have inner threads.

An illumination member has a second threaded portion which is threadedly connected to the first threaded portion so as to connect the illumination member with the connector. The second threaded portion has outer threads which are threadedly moveable relative to the first threaded portion to adjust the relative position between the illumination member and the body to adjust focus of the light assembly. A base is connected to one end of the illumination member and protrudes beyond the body.

The illumination member can be threadedly separated from the connector so that the rest of the parts of the light assembly and the illumination member are individually packed to reduce the storage space needed, and the transportation cost.

The present invention will become more obvious from the following description when taken in connection with the accompanying drawings which show, for purposes of illustration only, a preferred embodiment in accordance with the present invention.

DETAILED DESCRIPTION OF THE PREFERRED EMBODIMENT

Figure 1:
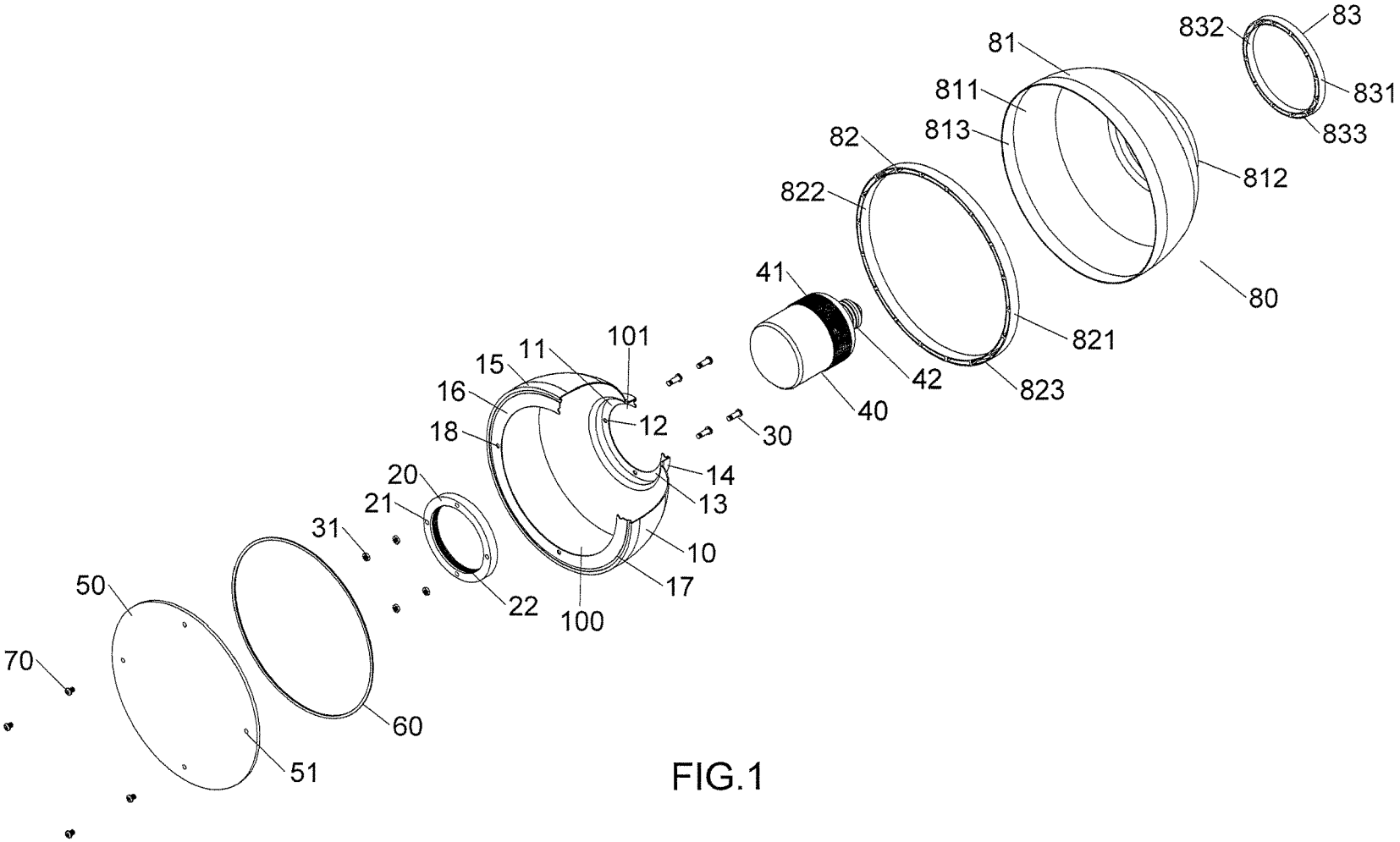
FIG. 1 is an exploded view to show the light assembly of the present invention.
Figure 2:
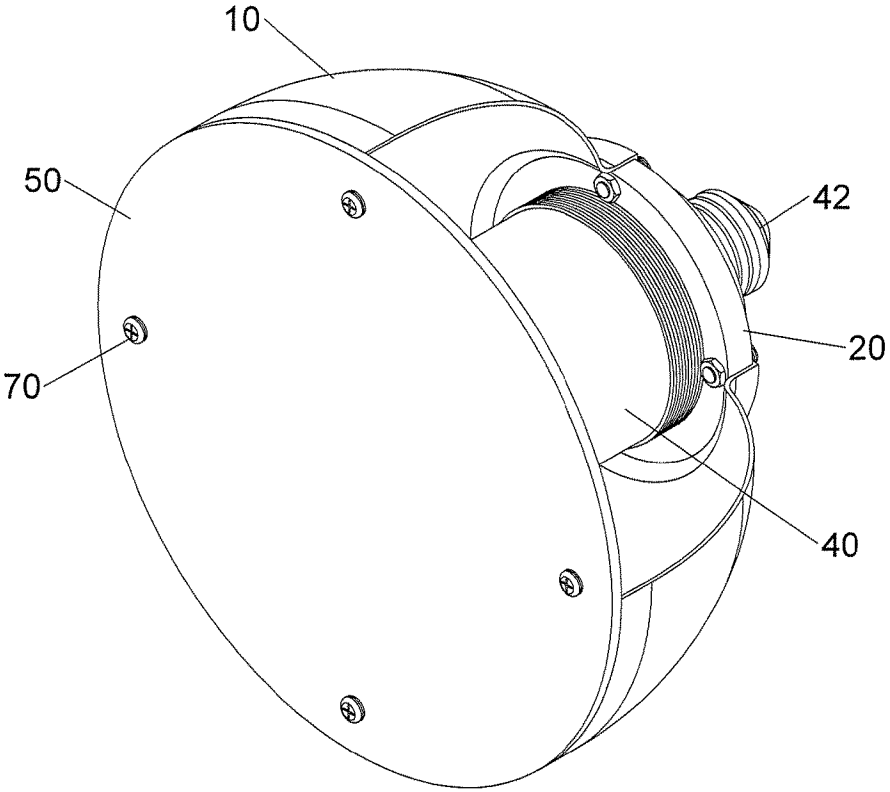
FIG. 2 is a perspective view to show the body of the light assembly of the present invention.
Figure 3:
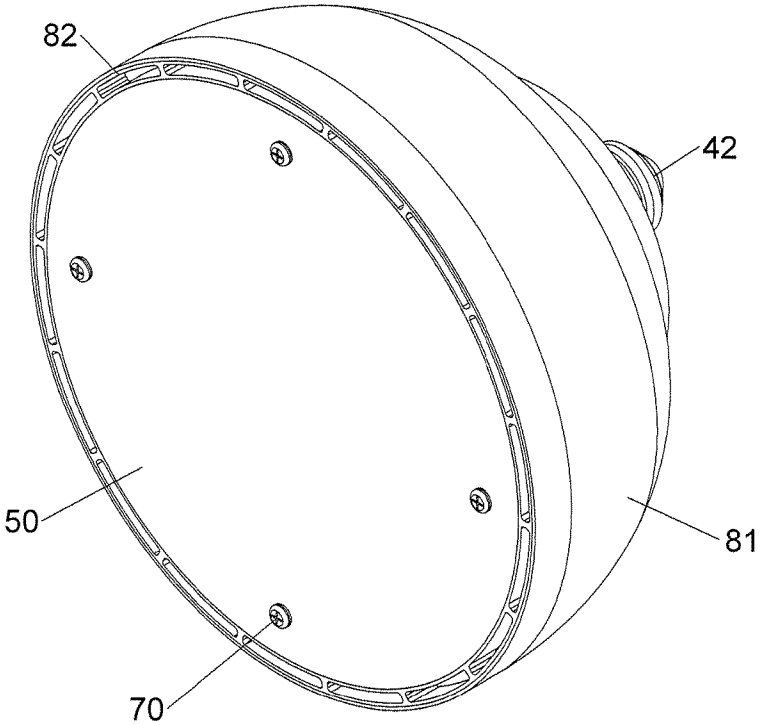
FIG. 3 is a perspective view to show the light assembly of the present invention.

Referring to FIGS. 1 to 3, the light assembly of the present invention comprises a body 10, a connector 20, multiple first threaded members 30, multiple second threaded members 31, an illumination member 40, a transparent plate 50, a first ring 60, multiple third threaded members 70 and a shade 80.

The body 10 is a cone-shaped member with a first opening 100 in the first end thereof, and a second opening 101 in the second end of the body 10, wherein the first opening 100 is larger than the second opening 101. The body 10 has a recessed area 11 defined in the second end of the body 10. The recessed area 11 is a circular recess and has a first flange 13. Multiple first holes 12 are defined through the first flange 13. The body 10 has a first outer periphery 14 on the second end of the body 10, and a second outer periphery 15 on the first end of the body 10. The body 10 has a second flange 16 formed in the first end thereof and a first groove 17 is defined in the outside of the second flange 16. The first groove 17 is located between the second flange 16 and the second outer periphery 15. The second flange 16 has multiple second holes 18.

The connector 20 is received in the recessed area 11 and contacts the first flange 13. The connector 20 is a ring-shaped member and has multiple third holes 21 which are located corresponding to the first holes 12. The number of the third holes 21 is the same as that of the first holes 12. The connector 20 has a first threaded portion 22 defined in the inner periphery thereof.

The multiple first threaded members 30 extend through the first holes 12 and the third holes 21, and are connected to multiple second threaded members 31 so as to connect the connector 20 to the body 10. The first threaded members 30 have outer threads and the second threaded members 31 have inner threads.

The illumination member 40 has a second threaded portion 41 which is threadedly connected to the first threaded portion 22 so as to connect the illumination member 40 with the connector 20. The second threaded portion 41 has outer threads which are threadedly moveable relative to the first threaded portion 22 to adjust the relative position between the illumination member 40 and the body 10 to be adapted to adjust focus of the light assembly. A base 42 is connected to one end of the illumination member 40 and protrudes beyond the body 10. The base 42 is a standard base 42 and is a spiral base in this embodiment.

The transparent plate 50 allows the beams from the illumination member 40 to pass through, and contacts the second flange 16 and is secured to the body 10. The transparent plate 50 has multiple fourth holes 51 which are located corresponding to the second holes 18. A first ring 60 is received in the first groove 17 and contacts the transparent plate 50. The first ring 60 seals the gap between the body 10 and the transparent plate 50 to provide water-proof feature. Multiple third threaded members 70 extend through the fourth holes 51 of the transparent plate 50 and the second holes 18 of the body 10 to secure the transparent plate 50 to the body 10. The number of the third threaded members 70 is the same as the number of the second holes 18 and the number of the fourth holes 51.

The body 10 is connected to the inside of the shade unit 80, and a gap is defined between the shade unit 80 and the body 10. The shade unit 80 comprises a shade 81, a first separator 82 and a second separator 83. The shape of the shade 81 is correspondent to that of the body 10 so as to be connected to the body 10. The transparent plate 50 is in flush with the opening of the shade 81. A room 811 is defined between the shade 81 and the body 10. The shade 81 has a small end and a large end, a first inside 812 is defined in the small end of the shade 81, and the first inside 812 is located corresponding to the first outer periphery 14 of the body 10. The shade 81 further has a second inside 813 defined in the large end thereof, and the second inside 813 is located corresponding to the second outer periphery 15 of the body 10. The first separator 82 is located in the room 811 and separates the shade 81 from the body 10. The first separator 82 is located in the large end of the shade 81, and has a third outside 821 defined in the outside thereof. The third outside 821 contacts the second inside 813 of the shade 81. The first separator 82 has a third inside 822 which contacts the second outer periphery 15 of the body 10. The first separator 82 has multiple first passages 823 which communicate with the room 811, and the first passages 823 are arranged as a circle. The second separator 83 is located in the room 811 and separates the shade 81 from the body 10. The second separator 83 is located in the small end of the shade 81 and has a fourth outside 841 defined in the outside thereof. The fourth outside 841 contacts the first outer periphery 14 of the body 10. The second separator 83 has multiple second passages 833 which communicate with the room 811, and the second passage 833 are arranged as a circle.

Figure 5:
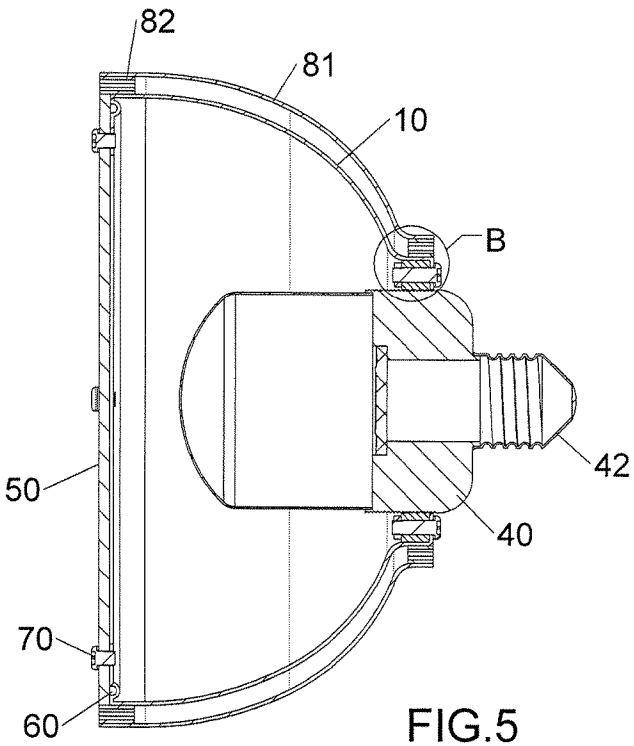
FIG. 5 is a cross sectional view, taken along line 5-5 in FIG. 4.
Figure 6:
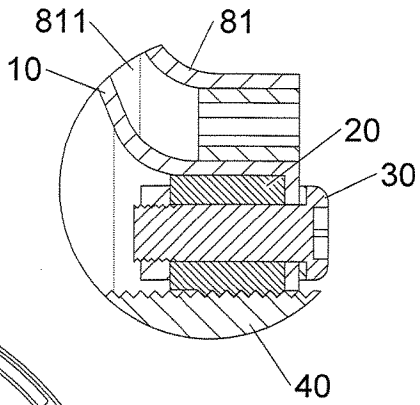
FIG. 6 is an enlarged view of the circled "B" in FIG. 5.
Figure 4:
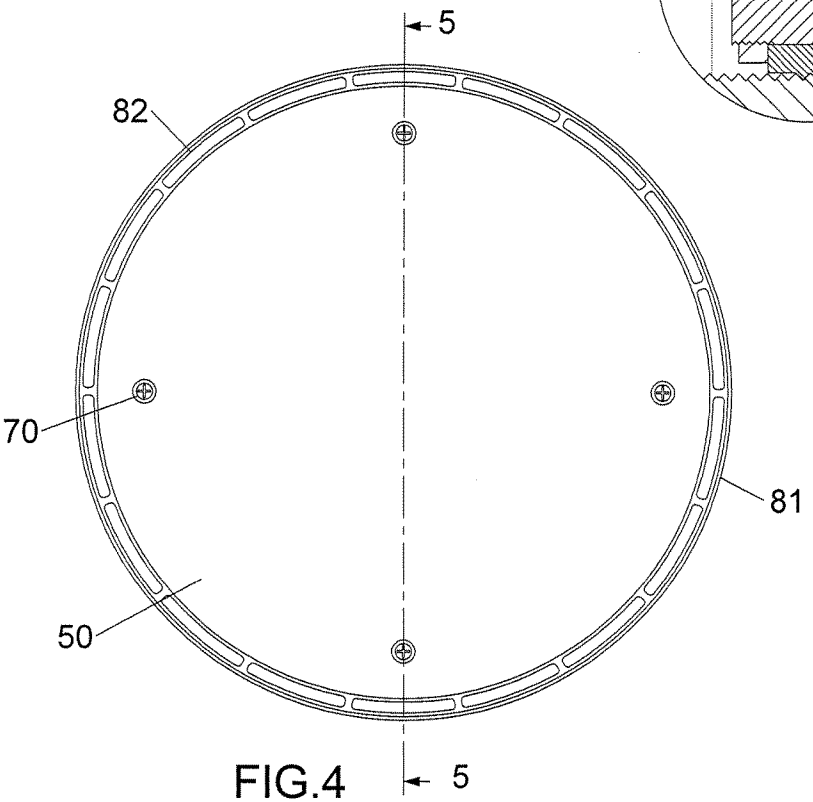
FIG. 4 is a front view of the light assembly of the present invention.

As shown in FIGS. 4 to 6, the connector 20 is tightly engaged with the recessed area 11, and the illumination member 40 is threadedly connected to the connector 20. The air passes through the first or second passages 823, 833 to reduce temperature in the room 811.

Figure 7:
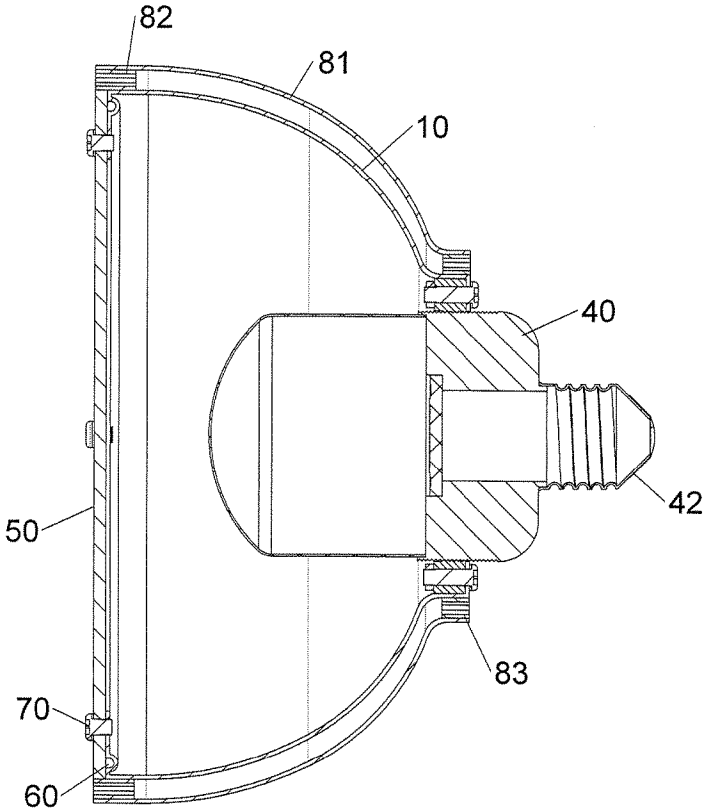
FIG. 7 is an operational status of the light assembly of the present invention, taken along line 5-5 in FIG. 4.

As shown in FIG. 7, the second threaded portion 41 of the illumination member 40 is capable of separating from the first threaded portion 22 to separate the illumination member 40 from the connector 20. Therefore, the illumination member 40 can be removed from the body 10, this feature allows the user to replace the illumination member 40.

Figure 10:
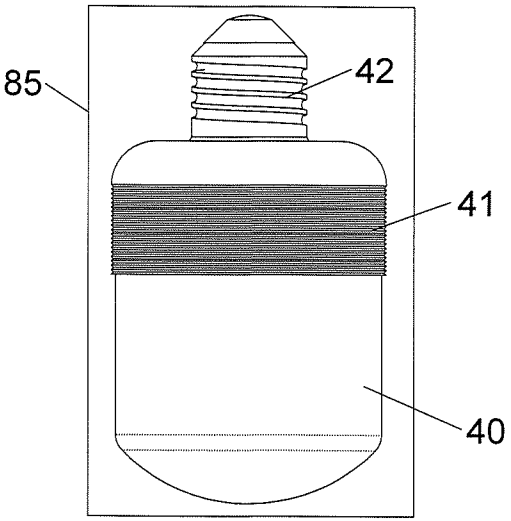
FIG. 10 is a top view of the illumination member of the light assembly of the present invention packed in the second packing material.
Figure 9:
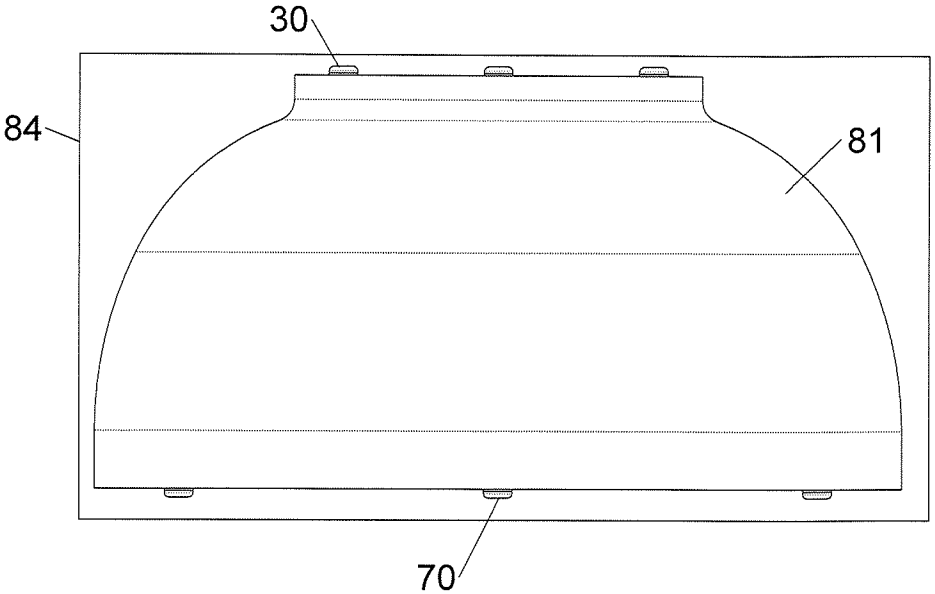
FIG. 9 is a top view of the parts of the light assembly of the present invention packed in the first packing material.

As shown in FIGS. 9 and 10, the body 10 and the connector 20 are packed in a first packing material 84, and the illumination member 40 is packed in a second packing material 85. This saves storage space and the transportation cost.

Figure 11:
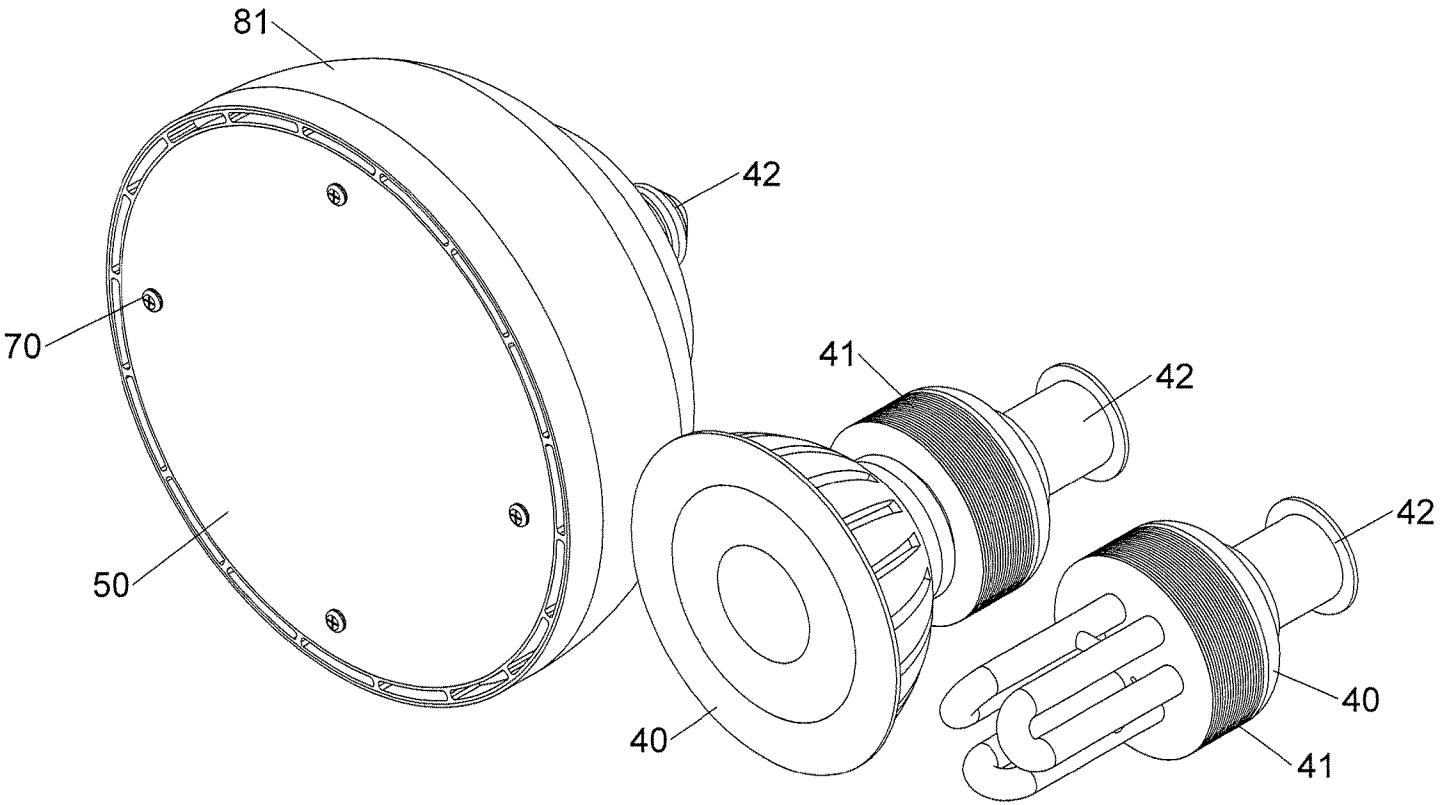
FIG. 11 is an exploded view to show the second embodiment of the light assembly of the present invention.

As shown in FIG. 11, there are multiple illumination members 40 and each illumination member 40 has the second threaded portion 41 which is connected to the first threaded portion 22. Each illumination member 40 can be connected to the connector 20.

Figure 12:
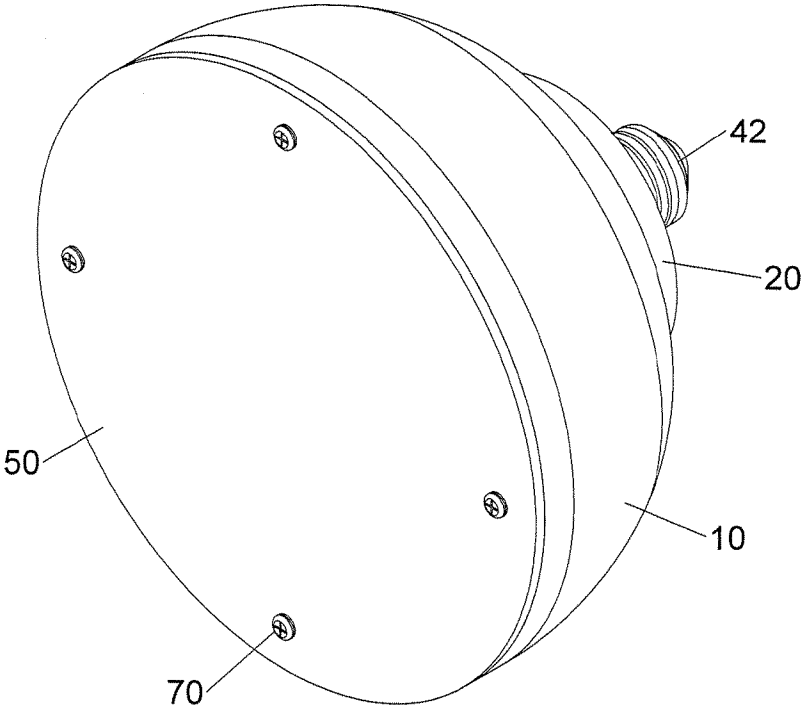
FIG. 12 is a perspective view to show the third embodiment of the body of the light assembly of the present invention.

FIG. 12 shows that the light assembly does not have the shade unit 80.

Figure 13:
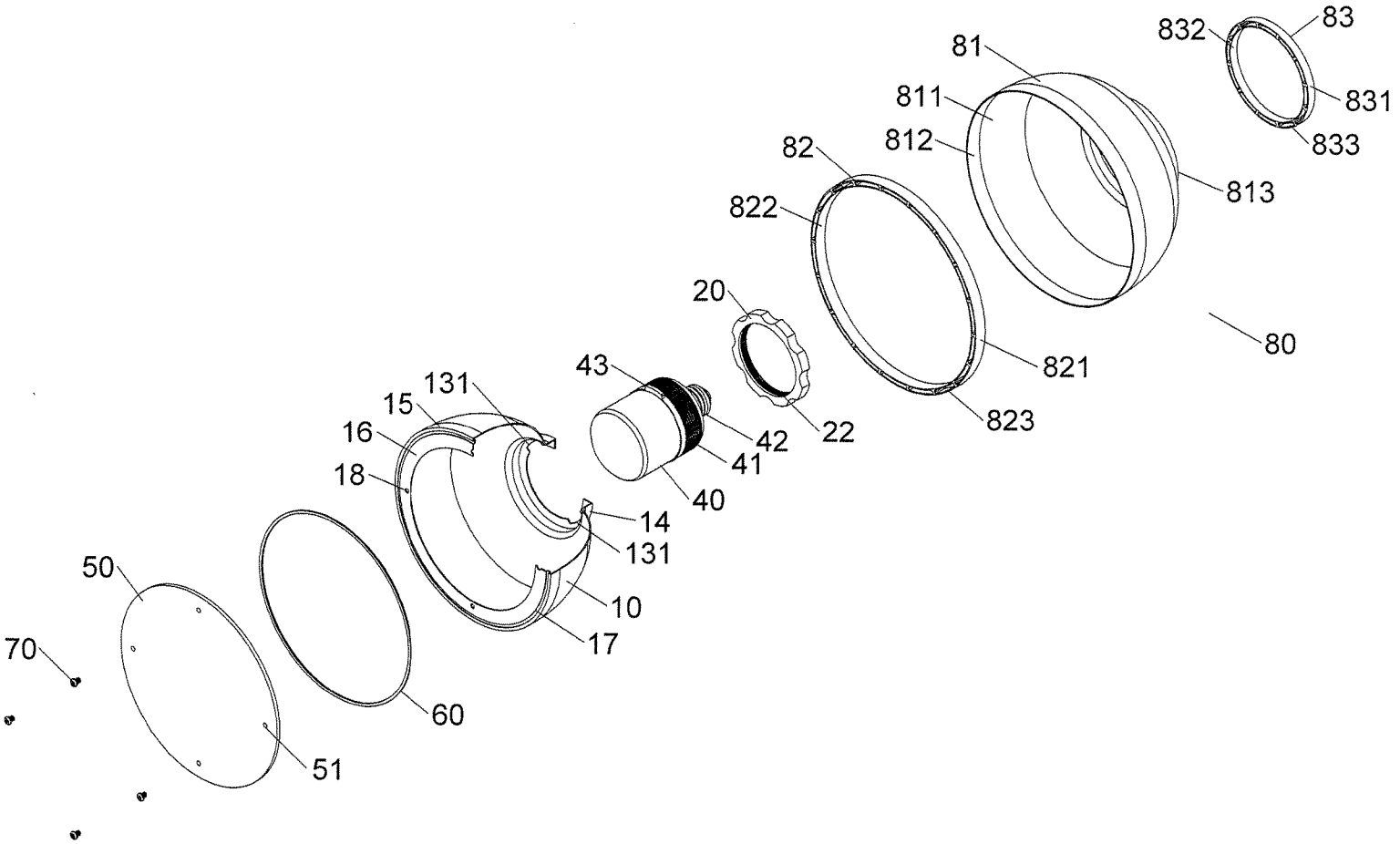
FIG. 13 is an exploded view to show the fourth embodiment of the light assembly of the present invention.
Figure 14:
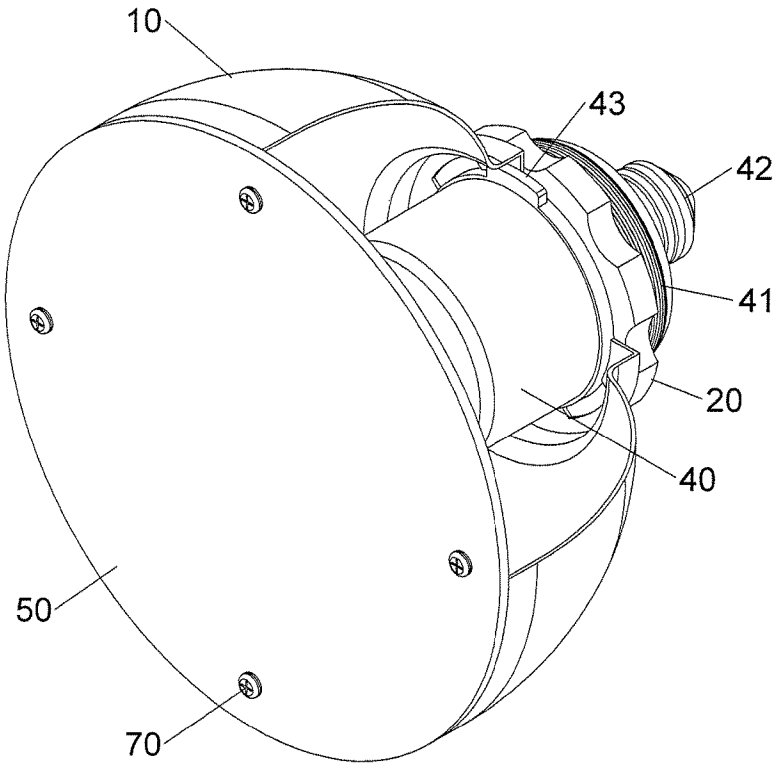
FIG. 14 shows the perspective view of the fourth embodiment of the light assembly of the present invention.
Figure 15:
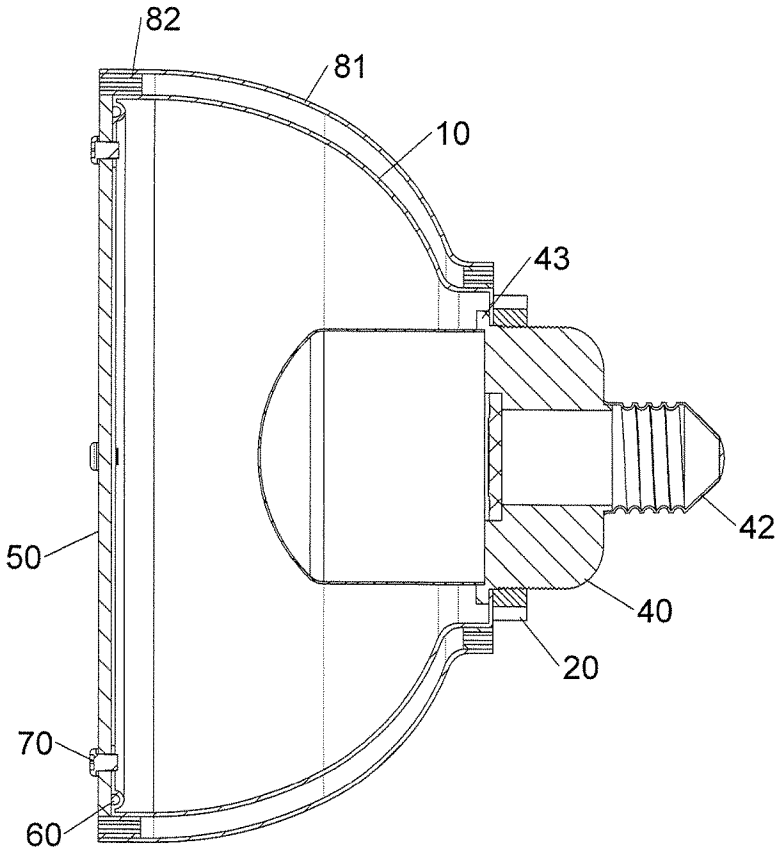
FIG. 15 is a cross sectional view to show the fourth embodiment of the light assembly of the present invention.

As shown in FIGS. 13 to 15, the first flange 13 of the body 10 has two first engaging portions 131 which face toward each other. The first engaging portions 131 each are a recessed portion. The connector 20 is a toothed ring. The illumination member 40 has two second engaging portions 43 protruding therefrom which are located close to the second threaded portion 41. The two second engaging portions 43 face toward each other. The second engaging portions 43 pass through the first engaging portions 131 and are rotated to be engaged with the first engaging portions 131. The connector 20 is threadedly connected to the second threaded portion 41 to connect the illumination member 40 to the body 10. When replacing the illumination member 40, the second threaded portion 41 is threadedly separated from the first threaded portion 22, and the illumination member 40 is rotated to pass the second engaging portion 43 through the first engaging portion 131 to remove the illumination member 40 from the body 10.

Figure 16:
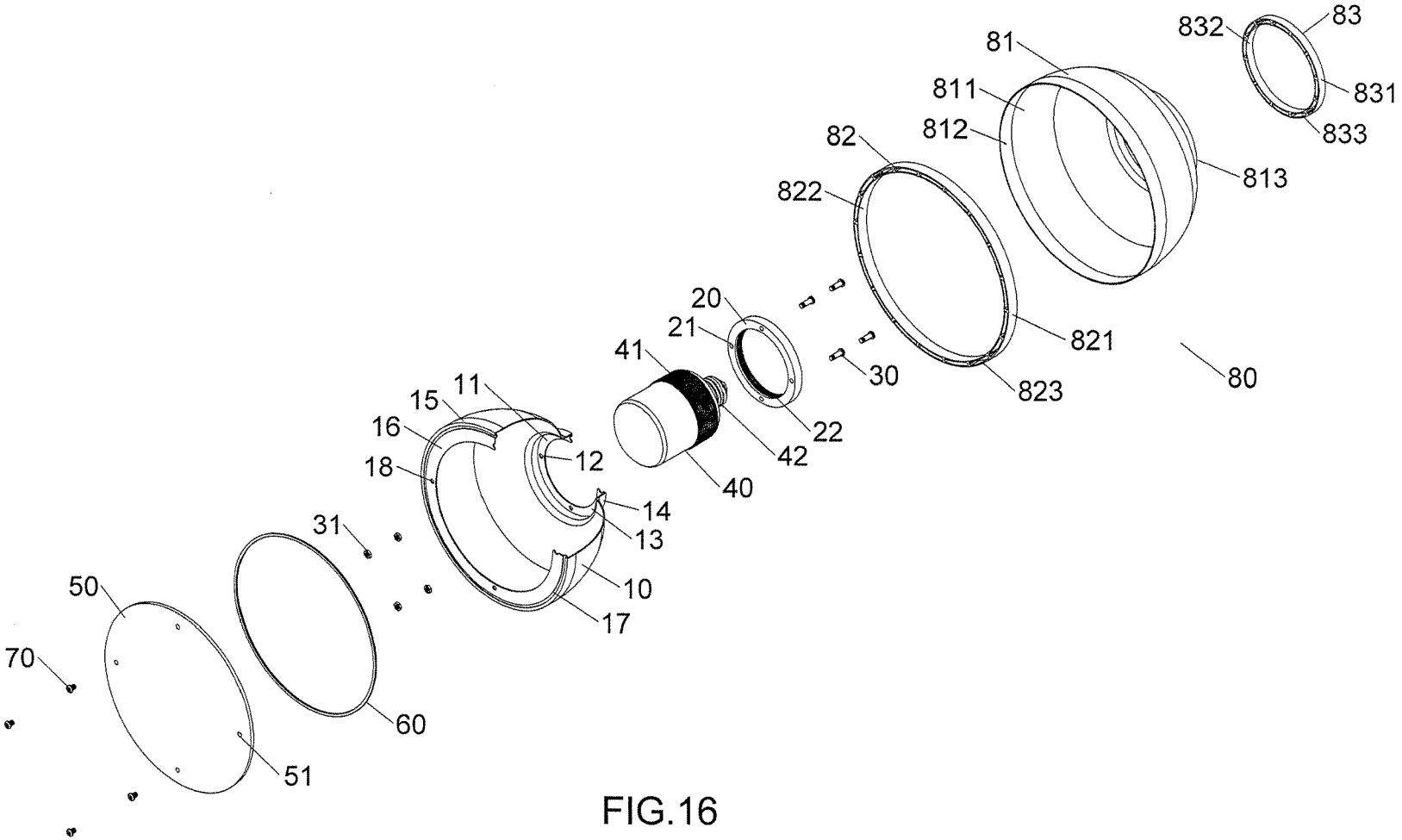
FIG. 16 is an exploded view to show the fifth embodiment of the light assembly of the present invention.
Figure 17:
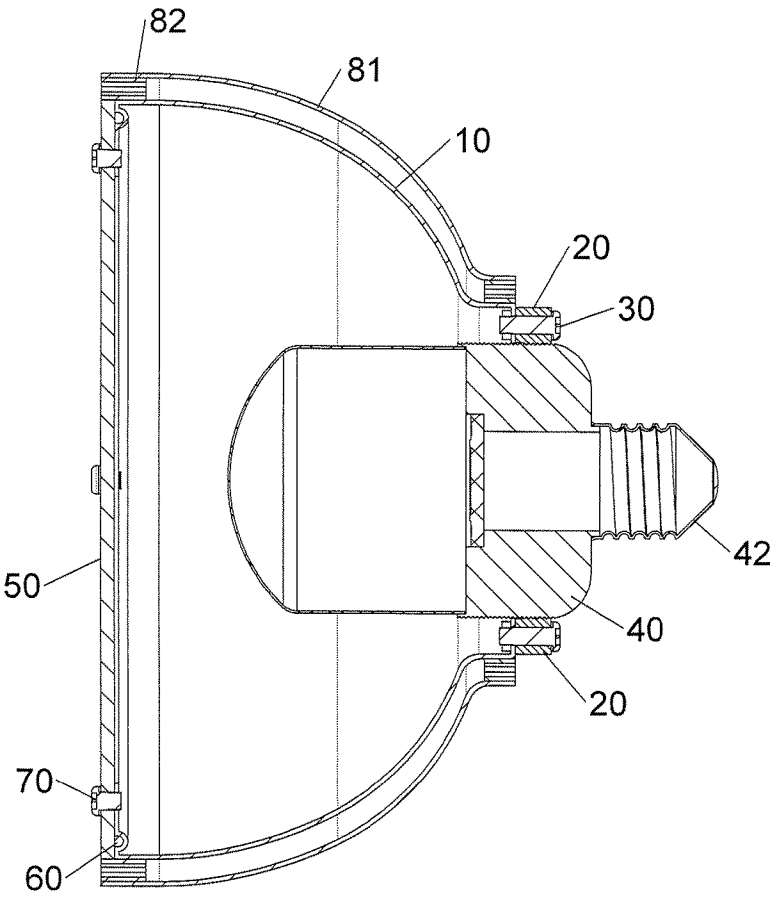
FIG. 17 is a cross sectional view to show the fifth embodiment of the light assembly of the present invention.

As shown in FIGS. 16 and 17, the connector 20 is fixed to the first flange 13 of the body 10 and protrudes beyond the body 10. The first threaded members 30 extend through the third holes 21 of the connector 20 and the first holes 12 of the body 10 and are connected to the second threaded members 31.

In yet another embodiment, the body 10 does not have the second flange 16, the first groove 17 and the multiple second holes 18. There is no transparent plate 50, the first ring 60 and the third threaded members 70 as well.

The advantages of the present invention are that the second threaded portion 41 of the illumination member 40 is threadedly connected to the first threaded portion 22 as shown in FIGS. 5 and 7. The second threaded portion 41 of the illumination member 40 is threadedly movable relative to the first threaded portion 22 to adjust the relative position between the illumination member 40 and the body 10. In other words, the focus of the light assembly is adjustable.

Figure 8:
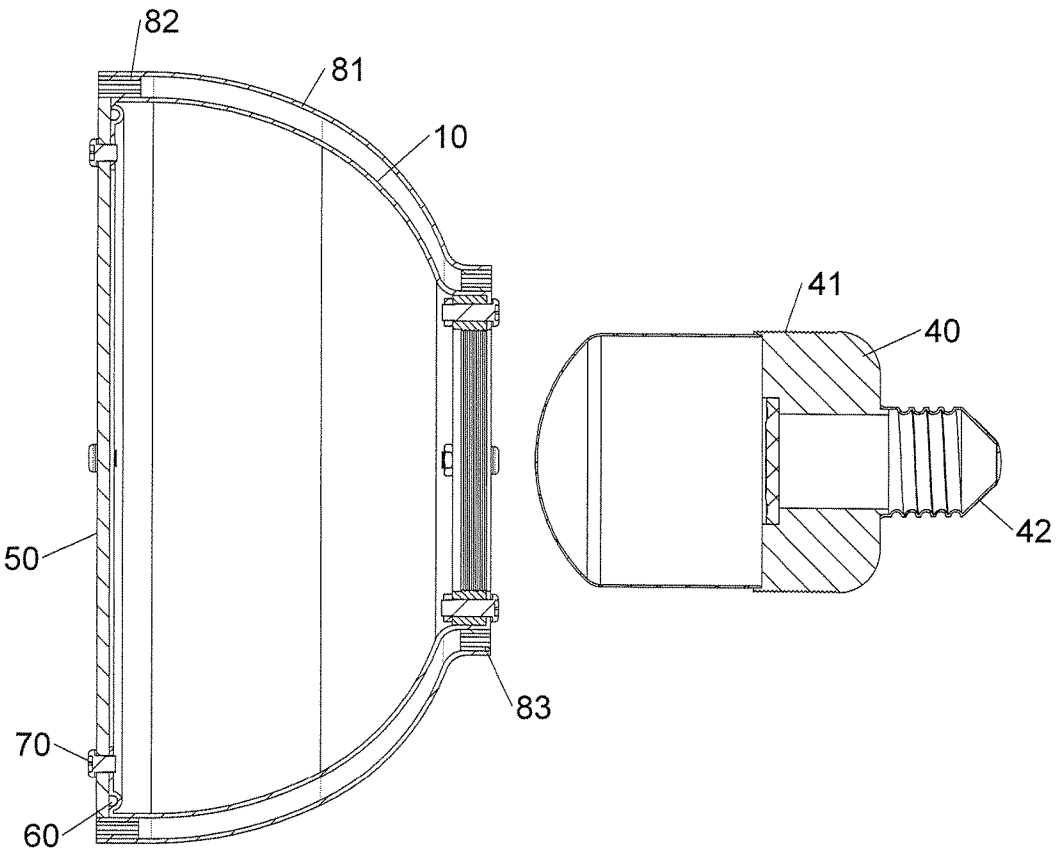
FIG. 8 is another operational status of the light assembly of the present invention, taken along line 5-5 in FIG. 4.

As shown in FIG. 8, the second threaded portion 41 of the illumination member 40 can be threadedly separated from the first threaded portion 22 to remove the illumination member 40 from the body 10, such that the replacement of the illumination member 40 is easy, and the whole set of the light assembly does not have to be discarded. The body 10, the transparent plate 50 and the shade 81 are saved.

As shown in FIGS. 9 and 10, the illumination member 40 is removed from the body 10. The body 10 and the connector 20 are packed in a first packing material 84, and the illumination member 40 is packed in a second packing material 85. Because the base 42 protrudes beyond the body 10 and the shade 81 when they are assembled, so that the illumination member 40 is separated from the body 10 and the connector 20 can save storage space and the transportation cost.

The first and second separators 82, 83 separate the shade 81 from the body 10. The first passages 823 and the second passages 833 of the first and second separators 82, 83 both communicate with the room 811. Air allows to pass through the first passages 823 and the second passages 833 of the first and second separators 82, 83 to bring heat from the room 811, such that the user does not get burn when touching the shade 81.

As shown in FIG. 11, each illumination member 40 has the second threaded portion 41 which is connected to the first threaded portion 22. Each illumination member 40 can be connected to the connector 20.

While we have shown and described the embodiment in accordance with the present invention, it should be clear to those skilled in the art that further embodiments may be made without departing from the scope of the present invention.

What is claimed is:

1. A light assembly comprising:

a body being a cone-shaped member with a first opening in a first end thereof, and a second opening in a second end of the body, the first opening being larger than the second opening, the body having a recessed area defined in the second end of the body, the recessed area being a circular recess and having a first flange, multiple first holes defined through the first flange, the body having a first outer periphery on the second end of the body, the body having a second outer periphery on the first end of the body; wherein the body having a second flange formed in the first end thereof and a first groove being defined in an outside of the second flange, the first groove being located between the second flange and the second outer periphery, the second flange having multiple second holes; a transparent plate contacting the second flange and being secured to the body; the transparent plate having multiple fourth holes which are located corresponding to the second holes, a first ring being received in the first groove and contacts the transparent plate, the first ring sealing a gap between the body and the transparent plate; multiple third threaded members correspondingly extending through the multiple fourth holes of the transparent plate and the multiple second holes of the second flange of the body to secure the transparent plate to the body; wherein the body being connected to an inside of a shade unit, a gap being defined between the shade unit and the body; wherein the shade unit comprising a shade, a first separator and a second separator; the shade being connected to the body, a room being defined between the shade and the body; the shade having a small end and a large end; the shade having a first inside defined in the small end thereof, the first inside being located corresponding to the first outer periphery of the body, the shade having a second inside defined in the large end thereof; the second inside being located corresponding to the second outer periphery of the body; the first separator being located in the room and separates the shade from the body; the first separator being located in the large end of the shade; the first separator having a third outside defined in an outside thereof; the third outside contacting the second inside of the shade; the first separator having a third inside which contacts the second outer periphery of the body, the first separator having multiple first passages which communicate with the room; the first passages being arranged as a circle; the second separator being located in the room and separating the shade from the body; the second separator being located in the small end of the shade and having a fourth outside defined in an outside thereof; the fourth outside contacting the first outer periphery of the body; the second separator having multiple second passages which communicate with the room; the second passages being arranged as a circle;

a connector received in the recessed area and contacting the first flange, the connector being a ring-shaped member and having multiple third holes which are located corresponding to the first holes, a number of the third holes being the same as that of the first holes, the connector having a first threaded portion defined in an inner periphery thereof;

multiple first threaded members extending through the first holes and the third holes, and connected to multiple second threaded members so as to connect the connector to the body, the first threaded members having outer threads and the second threaded members having inner threads, and an illumination member having a second threaded portion which is threadedly connected to the first threaded portion so as to connect the illumination member with the connector, the second threaded portion having outer threads which are threadedly moveable relative to the first threaded portion to adjust a relative position between the illumination member and the body to be adapted to adjust a focus of the light assembly, a base connected to one end of the illumination member and protruding beyond the body.

2. The light assembly as claimed in claim 1, wherein the connector is tightly engaged with the recessed area.

3. The light assembly as claimed in claim 1, wherein the base is a spiral member.

4. The light assembly as claimed in claim 1, wherein the second threaded portion of the illumination member is capable of separating from the first threaded portion to separate the illumination member from the connector.

5. The light assembly as claimed in claim 1, wherein the body and the connector are capable of being packed in a first packing material, and the illumination member is capable of being packed in a separate second packing material.

6. The light assembly as claimed in claim 1, wherein there are multiple illumination members and each illumination member has the second threaded portion which are capable of being connected to the first threaded portion.

* * * * *